US006978907B2

(12) United States Patent
Paschke

(10) Patent No.: US 6,978,907 B2
(45) Date of Patent: Dec. 27, 2005

(54) TELESCOPIC JIB FOR A VEHICULAR CRANE

(75) Inventor: Franz Paschke, Sande (DE)

(73) Assignee: Grove U.S. LLC, Shady Grove, PA (US)

( * ) Notice: Subject to any disclaimer, the term of this patent is extended or adjusted under 35 U.S.C. 154(b) by 33 days.

(21) Appl. No.: 10/317,169

(22) Filed: Dec. 12, 2002

(65) Prior Publication Data

US 2003/0106871 A1 Jun. 12, 2003

(51) Int. Cl.[7] ..... B66C 23/04
(52) U.S. Cl. ..... 212/348; 52/118
(58) Field of Search ..... 212/347–350; 52/721.1, 721.3, 722.1, 724.1–724.4, 118

(56) References Cited

U.S. PATENT DOCUMENTS 3,516,553 A * 6/1970 Reske ..... 212/350
5,884,791 A * 3/1999 Vohdin et al. ..... 212/348
6,108,985 A * 8/2000 Paschke et al. ..... 52/118

FOREIGN PATENT DOCUMENTS

| | | | | |
|---|---|---|---|---|
| DE | 94 02 692 | U1 | 5/1994 | |
| DE | 43 44 795 | A1 | 6/1995 | |
| DE | 196 24 312 | A1 | 1/1998 | |
| DE | 196 24 312 | C2 | 1/1998 | |
| DE | 200 04 016 | U1 | 5/2001 | |
| EP | 0 499 208 | B1 | 8/1992 | |
| EP | 0 668 238 | A1 | 8/1995 | |
| SU | 203878 | * | 12/1967 | ..... 212/349 |

* cited by examiner

*Primary Examiner*—Thomas J. Brahan
(74) *Attorney, Agent, or Firm*—Birch, Stewart, Kolasch & Birch, LLP

(57) ABSTRACT

A telescopic jib for a crane, such as a vehicular crane, comprises an upper profile part and a lower profile part joined together. The lower profile part consists of several shell segments, each having an outwardly curved shape, and the upper profile part comprises several outwardly curved shell segments abutting each other at an obtuse angle.

13 Claims, 3 Drawing Sheets

TELESCOPIC JIB FOR A VEHICULAR CRANE

BACKGROUND OF THE INVENTION

Telescopic jibs are used for cranes wherein the jib must be extended for use and retracted for other purposes, such as transport: Thus, such jibs are normally used for vehicular cranes. The sections of such jibs are typically tubular so that the successive sections can nest within each other when retracted and telescope outwardly to extend the jib to a desired length.

Such telescopic jibs execute hoisting operations with the load at their front end. As a result, the jib is exposed to a bending force in two main axes. Viewing the jib in cross section along its longitudinal axis, each jib section, when loaded, is subject to tensile stress on the upper side of the jib while, on the lower side, compressive stresses occur. Due to lateral forces and eccentric loading, horizontal bending and torsion also occur.

Designers of such jibs are principally interested in optimally configuring the cross-section for jib parts loaded in this way. Such a cross-section is easiest to devise when the maximum stresses are the same in every direction and approximate the permissible stress. These requirements are satisfied for instance in the case of thin-walled circular tubes or in the case of a square trussed structure only when uniform forces occur in all directions. If a cross-section is loaded, for instance, more in the vertical direction than in the horizontal, then an optimum rounded cross-section becomes an ellipse and an optimum cornered cross-section becomes a rectangular trussed structure, the cross-sections in both cases being higher than they are wide to account for the imbalanced forces.

A telescopic jib generally as described above is known, for example, from EP 0 499 208 B1. The cross-section of this telescopic jib consists of an upper profile part having a semi-box shaped configuration and a lower profile part, configured as a rounded half shell, welded to the free legs of the former. Although such totally round lower profile parts have good load introduction and stability properties, they do not compete with rectangular trussed structures with respect to stiffness. It is often necessary to install additional members, such as welded stiffeners, to promote stability to counteract buckling or to construct the jib of material that is somewhat thicker which has a negative effect on the weight of the jib overall.

A jib profile for cranes and vehicle cranes is known from EP 0 668 238 A1 in which the two upper leg sections of the lower profile, welded to the lower legs of the upper profile, are configured as straight strips. The remainder of the lower profile part has a curved shell shape. It is also proposed in this document, as an alternative, to employ a straight strip portion at another point of the lower profile part. These straight strip portions produce cross-sectional kinks in the profile at their edges. Due to these kinks the loading properties of such a profile once again approach those of a rectangular trussed structure; i.e., the stiffness can be increased. However, the drawback in such profile designs is that, due to the straight strips employed, the load introduction and stability properties which are particularly advantageous for curved profiles become poorer. Additional stiffeners or thicker material gauges are again needed which disadvantageously increases the overall weight of the jib.

German Utility Model No. 94 02 692 describes a jib profile comprising a substantially semi-box shaped upper section and a rounded lower section connected to the upper section, in which the lower section has at least one planar or flat wall section. This shape is utilized in an attempt to produce both sufficient resistance to buckling and sufficient load resistance against bending. A planar plate segment (wall section) is thus inserted into the cross-section of the lower profile. A disadvantage of this configuration is that planar plate segments or wall sections in such profiles strained by bending and buckling are weak points precisely with respect to buckling resistance. A further disadvantage of the planar segments is that, in the force introduction area between the points of overlap between adjacent jib sections, the planar strips or plates segments are substantially less able than curved shells to absorb transverse forces. Therefore, they have to be strengthened, for example by stiffeners, to counteract buckling.

DE 43 44 795 A1 describes a jib cross-section whose lower profile part consists of nine flat strips with adjacent stripe arranged at an obtuse angle with respect to each other. These strips form the plate segments of the lower profile part. They are all configured as flat plate segments, which again have the disadvantages regarding resistance to buckling.

Furthermore, DE 200 04 016 U1 describes a telescopic jib in which the coupling portion and/or at least one telescopic length consist of profiles, each of which having a lower, round part and an upper, semi-box shaped part, whose facing legs are welded to each other. The upper profile part has the shape of an isosceles trapezium without the longer base part, such that the legs of the upper and lower profile parts abut each other forming an angle which is smaller than 180° on the inner sides of the profiles. The lower profile part is made of material having relatively increased thickness. In this way, it is intended that a better resistance to buckling is achieved. For this purpose, however, the heavier lower profile part has to extend upwards far above the axis of the moment of inertia of the cross section, or the neutral zone, of the jib. Increasing the amount of material in the neutral zone is, however, not advantageous in a jib because it undesirably increases the weight of the jib itself.

Lastly, DE 196 24 312 C2 discloses a telescopic jib for a vehicular crane in which the upper profile part is semi-box shaped and the lower profile part consists of several shell segments adjacent to each other, each having an outwardly curved shape in the form of a circular arc. In this way, it is intended to combine the good load bearing and stability properties of curved profiles with the greater stiffness of a rectangular trussed structure, so that such a telescopic jib can be built particularly lightweight.

Despite the improvements achieved by the various shapes of the upper profile parts and lower profile parts of known jibs, there is still no optimum solution for extreme loads, such as in luffing jib operations, guyed or pre-tensioned systems, or when positioning a jib in an orientation approaching vertical. In such situations the tensile forces in the upper profile portion may be minimized, but large forces act along the main axis of the jib even while the load may be small, resulting in substantial lateral forces. The resulting lateral forces can be very large in these working positions, such that the jib may be in serious danger of buckling.

SUMMARY OF THE INVENTION

The invention provides a telescopic jib of the described type in which the disadvantages mentioned above do not occur. In particular, the invention provides a telescopic jib which exhibits increased resistance to buckling and which is, therefore, suitable for carrying extreme loads, such as in luffing jib operations, in guyed systems, or when positioning a jib carrying a substantial load while positioned in a nearly vertical orientation.

The advantages achieved with the invention are based on the fact that the upper profile part of a jib section is formed by several shell segments, each having an outwardly curved shape, with adjacent sections abutting each other at an obtuse angle. In this way, the joints between the individual outwardly curved segments act like idealized stiffeners to counteract buckling. This is of great advantage to luffing jib operations, in pre-tensioned and/or guyed jib systems, and when using a jib to lift a large load while in a nearly vertical orientation since, in a jib according to the invention, both the upper profile part and the lower profile part may be compression loaded. Unlike the telescopic jibs according to the prior art, the cross-section of the upper profile part of the shell is supportive in compression, and stiffness is increased in the telescopic jib profile according to the invention, while simultaneously minimizing the overall weight of the jib. Furthermore, the shape of the upper profile part according to the invention provides a greater capacity to absorb the forces that are transferred from the upper shell of one jib section to the next, larger jib section of a telescopic jib.

As compared to conventional jib profiles, an increase in load bearing is achieved with the configuration in accordance with the invention. This is accomplished with greater material stability, without increasing the amount, thickness or weight of material used. The result is a stronger more stable jib without any corresponding increase in jib weight.

The upper profile part of a telescopic jib according to the present invention consists of at least two curved shell segments. The number of shell segments actually used may vary depending on the desired shape of the jib and on the specific types of loads likely to be encountered. Preferably, three, four or more shell segments may be used. When configuring a "shield" shape, for instance, four shell segments are present in the upper profile part.

According to a preferred feature of the invention, the endmost segments of the upper and the lower profile parts comprise ends formed as straight legs such that the straight leg ends of the upper and lower profile parts can be welded to each other. This results in optimum force transfer from the upper profile part onto the lower profile part and vice versa, depending on the type of load. The welding joint between the lower profile part and the upper profile part is preferably maintained in the area of the neutral zone of the cross section of the jib. This arrangement is facilitated by the structure according to the invention. Since the curved shell segments abutting each other at an obtuse angle in the upper profile part provide a higher level of resistance to bending, the upper profile part can extend further downwardly into the area occupied, in the prior art jibs, by the lower profile part without adversely affecting the load bearing capacity of the jib. As a result it is easily possible to provide the welding joint between the upper profile part and the lower profile part in the area of the neutral zone of the jib cross section.

Rotation of the telescopic parts with respect to each other as a result of torsion is significantly reduced by the cross-sectional shape in accordance with the invention as a result of the multiple joints formed between the shell segments in the upper profile part and the lower profile part.

According to another preferred embodiment of the invention, the outwardly curved shell segments in the upper profile part may have positioned between them one, two or several straight or flat segments. This achieves a more even distribution of stresses and reduces ovaling of the cross-section due to strains from bending in the vertical plane. This is advantageous when substantial tensile forces are imposed on the upper profile part of the jib. In particular when such a straight or flat shell segment is situated in the upper horizontal area of the upper profile part, the advantages of conventional semi-box shaped upper profile parts can be utilized, as is sensible for certain applications. Introducing such a straight shell segment in a jib according to the invention reduces the overall height of the jib cross-section. This, in turn, reduces the jib height in the lowered position of the jib and, thus, the overall height of the crane with the jib stowed. This is of value when transporting a nested crane.

Furthermore, it is noted that the lowermost part of a jib section, which is received and supported in the distal end of the next larger section of the telescopic jib, must be supported overall by sliders. Such sliders are situated in the area of the cross section where the curved shell segments abut each other at an obtuse angle. By introducing a straight or flat shell segment, the sliders can be omitted at this point. The lengths of the sliders in the direction of the jib main axis can be optimized by varying the width of the straight segment.

Lastly, a straight or flat shell segment in the upper profile part is helpful for transport, production and assembly, since assembling devices for supporting and positioning such a jib section are not necessary.

BRIEF DESCRIPTION OF THE DRAWINGS

The invention will be more fully understood in light of the following description considered in conjunction with the appended drawings, in which.

DESCRIPTION OF THE PREFERRED EMBODIMENTS

Figure 1:
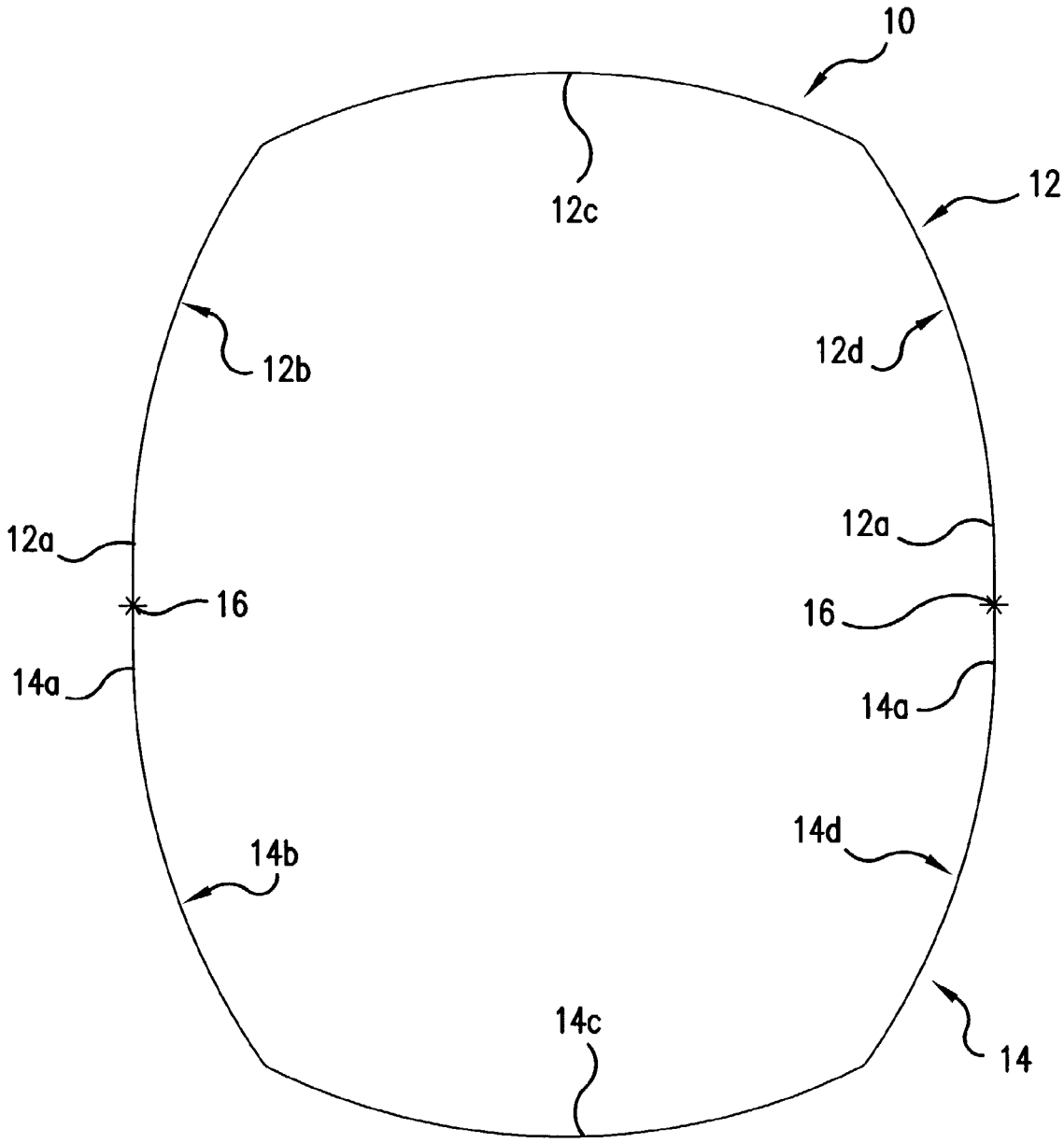
FIG. 1 is an axial cross-sectional view through a first embodiment of a jib section in accordance with the invention.

The drawing figures show a cross-section through a section of a telescopic jib. It is to be understood that the invention applies to either or both of a jib base section that may be supported on a vehicle or other base part of a crane, or to an extensible telescopic jib section that nests within the base section or within a further telescopic section. Typically, a jib comprises a base jib section and several telescopic sections of identical or substantially identical cross-sectional shape. This allows the telescopic parts to be nested within each other and within the base part with very small clearances from each other. Nesting of jib sections in compact fashion is facilitated by the invention since, for the reasons explained above, stiffening means such as additional welded-on stiffeners to counteract buckling may be dispensed with, and a thin wall structure may be employed. This results in a stable, more lightweight and compact telescopic jib.

A first embodiment of a telescopic jib section is shown in FIG. 1, generally indicated by the reference numeral 10. FIG. 1 is a sectional view of the jib section along the main axis thereof. As noted above, this section may be either the base section of a jib or a telescopic section.

The jib section of FIG. 1 consists of an upper profile part 12 and a lower profile part 14. The free leg ends 12*a* and 14*a* of the two profile parts 12, 14 are straight and are welded to each other at their end portions. The respective welding joints are indicated by the reference numerals 16. Welds 16 are situated in the neutral zone of the jib section. As is apparent, the upper profile part 12 and the lower profile part 14 have about the same vertical height.

The lower profile part is formed by three outwardly curved shell segments 14*b*, 14*c* and 14*d*. Each section 14*b*, 14*c* and 14*d* has the shape of a circular arc, though with respectively different radii of curvature. Segments 14*b* and 14*d* each include one of the straight leg portions 14*a* that are welded to the upper profile part.

In a similar way, the upper profile part 12 consists of three outwardly curved shell segments 12*b*, 12*c* and 12*d*, each of which likewise has the shape of a circular arc, with respectively different radii of curvature. The two shell segments 12*b* and 12*d* include the straight parts 12*a* which are welded to the straight parts 14*a* of the lower profile part 14.

As can be seen, the shell segments 12*b*, 12*c*, and 12*d* form obtuse angles with each other at their respective meeting points and at the points where they meet with the connecting straight parts 12*a*, respectively. This also applies to the lower shell segments 14*a*, 14*b*, 14*c* and 14*d*.

Figure 2:
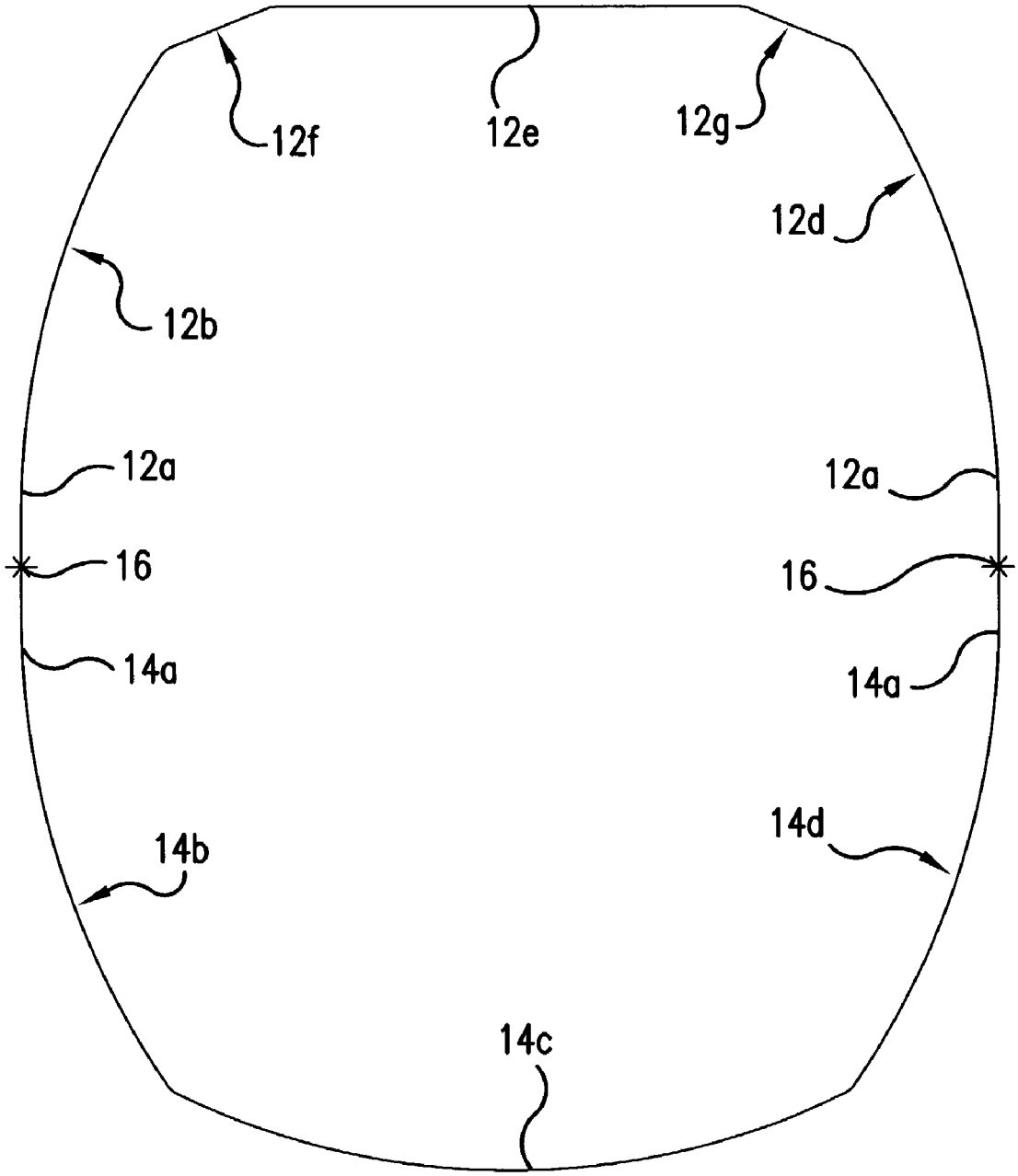
FIG. 2 is a similar cross-sectional view through a second embodiment of a jib section according to the invention.

FIG. 2 shows the cross-sectional shape of a second embodiment of a jib section according to the invention. This second embodiment differs from the cross-sectional shape according to FIG. 1 in that a straight or flat shell segment 12*e* has been introduced into the upper profile part 12. This straight shell segment 12*e* replaces a part of the upper segment 12*c* of the embodiment according to FIG. 1 and extends horizontally, both in the representation according to FIG. 2 as well as when such a telescopic jib is used. A pair of short outwardly curved segments 12*f* and 12*g* are connected to the straight segment 12*e* and to the curved segments 12*b*, 12*d*, respectively. The respective segments meet at obtuse angles as discussed above with respect to the embodiment of FIG. 1.

The embodiment according to FIG. 2 may be modified to include other straight segments or additional straight segments between the outwardly curved shell segments 12*b* and 12*f* and/or 12*g* and 12*d*.

The number of curved shell segments in the upper profile part 12, which is shown as three in the embodiment of FIG. 1, is not limited to three. As shown in the embodiment of FIG. 2 the upper profile part may include five segments. The upper profile part should comprise at least two segments in accordance with the teachings of the invention. Any even or odd number of segments, such as four or five outwardly curved shell segments may also be used.

Figure 3:
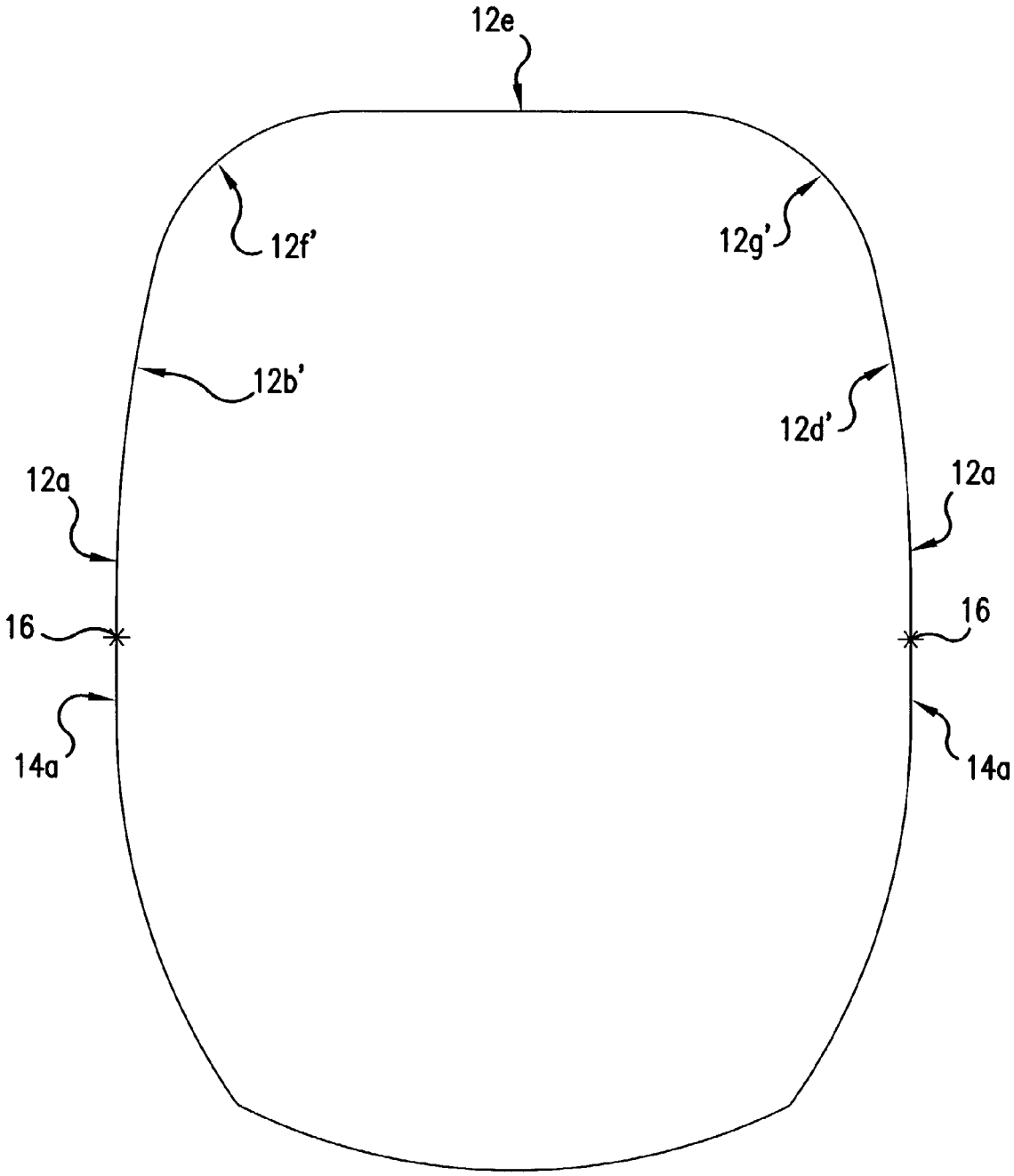
FIG. 3 is another similar cross-sectional view through a third embodiment of a jib section according to the invention.

FIG. 3 illustrates in cross-sectional view the shape of a third embodiment of a jib according to the present invention. Like the embodiment of FIG. 2, the embodiment of FIG. 3 includes a flat or straight segment 12*e*. Segment 12*e* is joined at its ends to outwardly curved shell segments 12*g*' and 12*f*' at the right and left upper corners of the upper profile part 12. Curved segments 12*g*' and 12*f*' have a relatively small radius of curvature. Segments 12*g*' and 12*f*' merge tangentially into the central straight shell segment 12*e* on one side and into the outwardly curved shell segments 12*b*' and 12*d*', respectively, on their other sides.

The outwardly curved segments of the jib provide excellent resistance to compressive forces. The relatively sharp "creases" formed at the joints where the curved segments meet at obtuse angles provide enhanced stiffness. This avoids any need for additional stiffeners, thus maintaining a desirably clean profile, desirably low overall weight and a compact nested jib structure. All of this is achieved also without unnecessarily increasing the thickness of the material from which the jib is fabricated and, thus, avoids undesirable increase in the dead weight of the jib. This enhanced strength and rigidity is especially important in the upper profile part of the jib, as discussed above.

I claim:

1. A telescopic jib for a crane, said telescopic jib comprising a base jib part supported on said crane and a retractable and extensible telescopic jib part supported by said base jib part, wherein at least one of said jib parts comprises an upper profile part and a lower profile part, said lower profile part consists of a plurality of adjacent shell segments each having an outwardly curved shape, and said upper profile part consists of a plurality of adjacent shell segments having an outwardly curved shape, the end portions of adjacent segments of said upper profile part meeting each other at an obtuse angle.

2. The telescopic jib as set forth in claim 1, wherein said upper profile part and said lower profile part each consists of at least three shell segments.

3. The telescopic jib as set forth in claim 1, wherein each of said curved shell segments is configured at least partially in the shape of a circular arc.

4. A telescopic jib for a crane, said telescopic jib comprising a base jib part supported on said crane and a retractable and extensible telescopic jib part supported by said base jib part, wherein at least one of said jib parts comprises an upper profile part and a lower profile part, said lower profile part consists of a plurality of adjacent shell segments each having an outwardly curved shape;

said upper profile part consists of a plurality of adjacent shell segments having an outwardly curved shape, the ends of adjacent segments of said upper profile part meeting each other at an obtuse angle;

wherein the endmost segments of said upper and lower profile parts comprise free ends formed as straight legs, and said upper and lower profile parts are welded to each other at their adjacent straight legs.

5. The telescopic jib as set forth in claim 4, wherein the straight legs of said upper profile part and said lower profile part are welded in the area of the neutral zone of said at least one jib part.

6. The telescopic jib as set forth in claim 3, wherein that at least some of said curved shell segments of said upper profile part each have the shape of a circular arc with respectively differing radii of curvature.

7. A telescopic jib for a crane, said telescopic jib comprising a base jib part supported on said crane and a retractable and extensible telescopic jib part supported by said base jib part, wherein at least one of said jib parts comprises an upper profile part and a lower profile part, said lower profile part consists of a plurality of adjacent shell segments each having an outwardly curved shape, and said upper profile part consists of a plurality of adjacent shell segments having an outwardly curved shape, the end portions of adjacent segments of said upper profile part meeting each other at an obtuse angle and at least one intervening straight segment interposed between two of said segments having an outwardly curved shape.

8. The telescopic jib as set forth in claim 7, wherein said at least one intervening straight segment of said upper profile part is a central straight segment, and said plurality of adjacent shell segments of said upper profile part having an outwardly curved shape include a first outwardly curved shell segment on each side of said central straight segment, said first outwardly curved segments having a relatively small radius of curvature, and a second outwardly curved shell segment adjacent each said first outwardly curved shell segment, each of said second outwardly curved shell segments having a relatively large radius of curvature.

9. A telescopic jib for a crane, said telescopic jib comprising a base jib part supported on said crane and a retractable and extensible telescopic jib part supported by said base jib part, wherein at least one of said jib parts consists essentially of an upper profile part and a lower profile part, said lower profile part consists of a plurality of adjacent shell segments each having an outwardly curved shape, and said upper profile part consists of a pair of shell segments having an outwardly curved shape, and an intervening straight segment interposed between said outwardly curved segments.

10. A telescopic jib for a crane, said telescopic jib comprising a base jib part supported on said crane and a retractable and extensible telescopic jib part supported by said base jib part, wherein at least one of said jib parts comprises an upper profile part and a lower profile part, said lower profile part consists of a plurality of adjacent shell segments each having an outwardly curved shape;

said upper profile part consists of a pair of shell segments having an outwardly curved shape, and an intervening straight segment interposed between said outwardly curved segments wherein the endmost segments of said upper and lower profile parts comprise free ends formed as straight legs, and said upper and lower profile parts are welded to each other at their adjacent straight legs.

11. A telescopic jib for a crane, said telescopic jib comprising a base jib part supported on said crane and a retractable and extensible telescopic jib part supported by said base jib part, wherein at least one of said jib parts comprises an upper profile part and a lower profile part, said lower profile part consists of a plurality of adjacent shell segments each having an outwardly curved shape, and said upper profile part consists essentially of a central straight segment, a first outwardly curved shell segment on each side of said central straight segment, said first outwardly curved segments having a relatively small radius of curvature, and a second outwardly curved shell segment adjacent each said first outwardly curved shell segment, each of said second outwardly curved shell segments having a relatively large radius of curvature.

12. A telescopic jib for a crane, said telescopic jib comprising a base jib part supported on said crane and a retractable and extensible telescopic jib part supported by said base jib part, wherein at least one of said jib parts consists of an upper profile part and a lower profile part, said lower profile part consists of a plurality of adjacent shell segments each having an outwardly curved shape, and said upper profile part comprises a pair of first outwardly curved shell segments, said first outwardly curved segments having a relatively small radius of curvature, and a second pair of outwardly curved shell segments adjacent said respective first outwardly curved shell segments, each of said second outwardly curved shell segments having a relatively large radius of curvature.

13. A telescopic jib for a crane, said telescopic jib comprising a base jib part supported on said crane and a retractable and extensible telescopic jib part supported by said base jib part, wherein at least one of said jib parts consists of an upper profile part and a lower profile part, said lower profile part consists of a plurality of adjacent shell segments each having an outwardly curved shape, and said upper profile part comprises at least a first outwardly curved shell segment having a relatively small radius of curvature, and a pair of outwardly curved shell segments having a relatively large radius of curvature.

* * * * *